US009353746B2

(12) United States Patent
Hockliffe et al.

(10) Patent No.: US 9,353,746 B2
(45) Date of Patent: May 31, 2016

(54) SCROLL PUMP

(75) Inventors: Miles Geoffery Hockliffe, Lewes (GB); Ian David Stones, Burgess Hill (GB); Alan Ernest Kinnaird Holbrook, Pulborough (GB)

(73) Assignee: Edwards Limited, Crawley (GB)

( * ) Notice: Subject to any disclaimer, the term of this patent is extended or adjusted under 35 U.S.C. 154(b) by 99 days.

(21) Appl. No.: 13/389,856

(22) PCT Filed: Jun. 30, 2010

(86) PCT No.: PCT/GB2010/051078

§ 371 (c)(1),
(2), (4) Date: Feb. 10, 2012

(87) PCT Pub. No.: WO2011/018642

PCT Pub. Date: Feb. 17, 2011

(65) Prior Publication Data

US 2012/0141311 A1 Jun. 7, 2012

(30) Foreign Application Priority Data

Aug. 14, 2009 (GB) ..... 0914220.9

(51) Int. Cl.
*F01C 1/063* (2006.01)
*F04C 18/02* (2006.01)
(Continued)

(52) U.S. Cl.
CPC ..... *F04C 18/0215* (2013.01); *F01C 19/005* (2013.01); *F04C 18/0284* (2013.01); *F04C 27/005* (2013.01)

(58) Field of Classification Search
CPC ..... F04C 27/005; F04C 18/0284; F04C 18/0215; F04C 18/0276; F04C 18/0269; F01C 19/005
USPC ..... 418/5, 55.1, 55.4, 142
See application file for complete search history.

(56) References Cited

U.S. PATENT DOCUMENTS 4,415,317 A 11/1983 Butterworth
4,437,820 A * 3/1984 Terauchi et al. ..... 418/55.4
(Continued)

FOREIGN PATENT DOCUMENTS

CN 101449061 A 6/2009
EP 0041802 A1 5/1981
(Continued)

OTHER PUBLICATIONS

Office Action dated Oct. 15, 2013 in U.S. Appl. No. 13/389,096, 14 pgs.
(Continued)

*Primary Examiner* — Thomas Denion
*Assistant Examiner* — Thomas Olszewski
(74) *Attorney, Agent, or Firm* — Shumaker & Sieffert, P.A.

(57) ABSTRACT

A scroll compressor may include a scroll pumping mechanism which includes an orbiting scroll having an orbiting scroll wall extending axially from an orbiting scroll plate towards a fixed scroll and a fixed scroll having a fixed scroll wall extending axially from a fixed scroll plate towards the orbiting scroll. An axial end portion of one of the scroll walls includes a first sealing arrangement and a second sealing arrangement arranged in series along the scroll wall from the inlet to the outlet for sealing between the axial end portion of the scroll wall and the scroll plate of the opposing scroll. The first sealing arrangement may have first sealing characteristics which are selected according to the sealing requirements local to the first sealing arrangement and the second sealing arrangement may have second, different sealing characteristics which are selected according to sealing requirements local to the second sealing arrangement.

9 Claims, 7 Drawing Sheets

(51) Int. Cl.
*F01C 19/00* (2006.01)
*F04C 27/00* (2006.01)

(56) References Cited

U.S. PATENT DOCUMENTS

| | | | | |
|---|---|---|---|---|
| 4,462,771 | A | 7/1984 | Teegarden | |
| 4,561,832 | A | 12/1985 | Shimizu | |
| 4,627,799 | A | 12/1986 | Terauchi | |
| 4,730,375 | A | 3/1988 | Nakamura et al. | |
| 4,740,143 | A * | 4/1988 | Nakamura et al. | 418/55.4 |
| 4,753,583 | A | 6/1988 | Hiraga et al. | |
| 4,824,343 | A | 4/1989 | Nakamura et al. | |
| 4,869,658 | A | 9/1989 | Tsutsumi et al. | |
| 5,035,589 | A | 7/1991 | Fraser, Jr. et al. | |
| 5,767,186 | A | 6/1998 | Shimokusuzono et al. | |
| 5,833,443 | A | 11/1998 | Lifson | |
| 6,068,459 | A | 5/2000 | Clarke et al. | |
| 6,193,487 | B1 | 2/2001 | Ni | |
| 6,354,825 | B1 * | 3/2002 | Fujiwara et al. | 418/220 |
| 6,720,071 | B2 * | 4/2004 | Ishii | 428/367 |
| 6,783,338 | B2 * | 8/2004 | Moroi et al. | 418/55.2 |
| 6,860,728 | B2 | 3/2005 | Takeuchi et al. | |
| 6,887,052 | B1 | 5/2005 | Bush et al. | |
| 7,364,418 | B2 * | 4/2008 | Masuda et al. | 418/142 |
| 7,950,912 | B2 * | 5/2011 | Sato et al. | 418/55.2 |
| 2002/0057976 | A1 * | 5/2002 | Kimura et al. | 418/55.2 |
| 2003/0063989 | A1 | 4/2003 | Rinella | |
| 2010/0086427 | A1 | 4/2010 | Kudo | |

FOREIGN PATENT DOCUMENTS

| | | | |
|---|---|---|---|
| EP | 0438025 | A3 | 7/1991 |
| EP | 1876356 | A1 | 1/2008 |
| EP | 2055955 | A1 | 6/2009 |
| JP | 55037515 | A | 3/1980 |
| JP | 1106989 | A | 10/1987 |
| JP | 02009975 | A | 6/1988 |
| JP | 02149785 | A | 11/1988 |
| JP | 07077181 | A | 3/1995 |
| JP | 07158568 | A | 6/1995 |
| JP | 08261171 | A | 8/1996 |
| JP | 9195958 | A | 7/1997 |
| JP | H09256972 | A | 9/1997 |
| JP | 10009158 | A | 1/1998 |
| JP | 10047265 | A | 2/1998 |
| JP | H11280676 | A | 10/1999 |
| JP | 2001003882 | A | 1/2001 |
| JP | 2005163745 | A | 12/2003 |
| JP | 2005351111 | A | 6/2004 |
| JP | 2006097656 | A | 9/2004 |
| JP | 2006307760 | A | 11/2006 |
| JP | 2008184944 | A | 1/2007 |
| WO | 9817895 | A1 | 4/1998 |
| WO | 0022302 | A | 4/2000 |

OTHER PUBLICATIONS

U.S. Appl. No. 13/389,096, filed Feb. 6, 2012 entitled Scroll Pump.

U.S. Appl. No. 13/389,328, filed Feb. 7, 2012 entitled Scroll Pump.

Response filed Jan. 15, 2014 to the Office Action dated Oct. 15, 2013 in U.S. Appl. No. 13/389,096, 21 pgs.

Final Office Action dated Apr. 24, 2014 in U.S. Appl. No. 13/389,096, 29 pgs.

Response filed Jun. 24, 2014 to the Office Action dated Apr. 24, 2014 in U.S. Appl. No. 13/389,096, 33 pgs.

Examination Report from counterpart Patent Application No. GB0914220.9, dated Nov. 11, 2014, 5 pp.

Examination Report from counterpart Application No. GB1202156.4, dated Feb. 4, 2015, 2 pp.

First Office Action and Search Report, and translation thereof, from counterpart Taiwan Application No. 099124195, dated Nov. 26, 21015, 7 pp.

Final Office Action from U.S. Appl. No. 13/389,096, dated Nov. 16, 2015, 28 pp.

Office Action from U.S. Appl. No. 13/389,096, dated May 15, 2015, 20 pp.

Examination Report from counterpart Patent Application No. GB0914220.9, dated May 12, 2015, 3 pp.

Response to the Office Action mailed May 15, 2015, from U.S. Appl. No. 13/389,096, filed Aug. 10, 2015, 16 pp.

English Translation of Search Report from Taiwan Patent Application No. 099124195, Apr. 28, 2015, 1 pp.

Examination Report from counterpart Great Britain application No. GB1202156.4, dated Jul. 2, 2015, 4 pp.

* cited by examiner

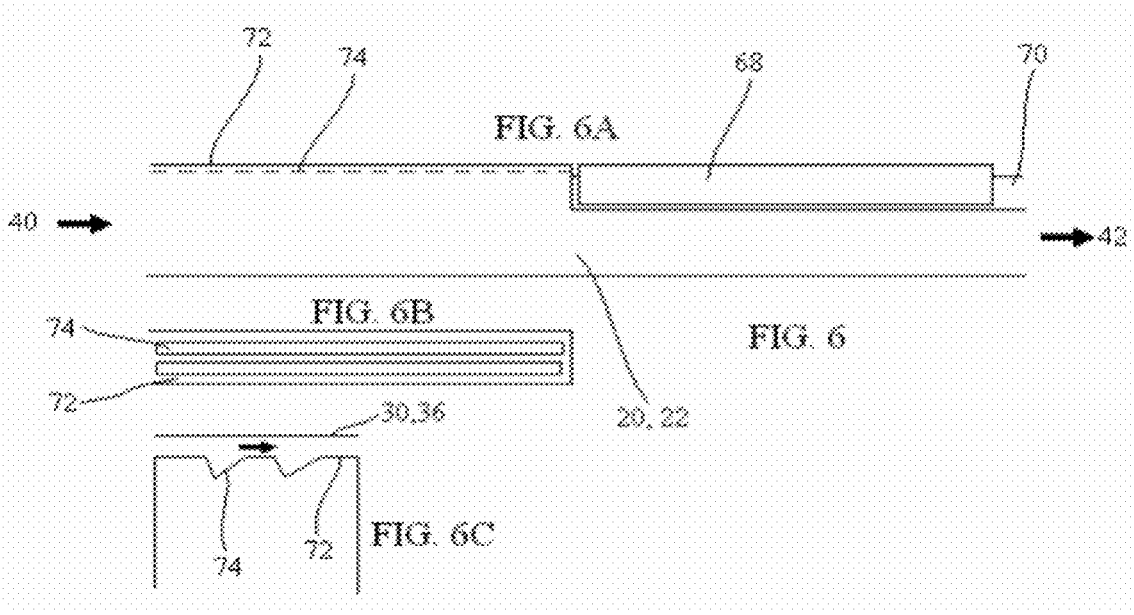
72
74
68
70
FIG. 6A
40
42
FIG. 6B
74
72
20, 22
FIG. 6
30,36
74
72
FIG. 6C
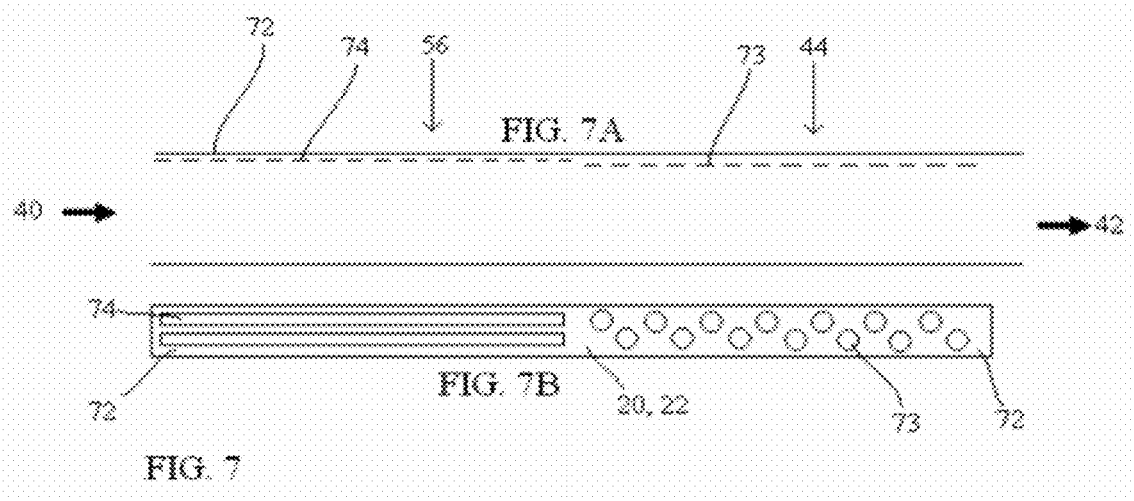
72
74
56
73
44
FIG. 7A
40
42
74
72
FIG. 7B
20, 22
73
72
FIG. 7

SCROLL PUMP

TECHNICAL FIELD

The present invention relates to a scroll pump, which is often referred to as a scroll compressor.

BACKGROUND

A prior art scroll compressor, or pump, 100 is shown in FIG. 10. The pump 100 comprises a pump housing 102 and a drive shaft 104 having an eccentric shaft portion 106. The shaft 104 is driven by a motor 108 and the eccentric shaft portion is connected to an orbiting scroll 110 so that during use rotation of the shaft imparts an orbiting motion to the orbiting scroll relative to a fixed scroll 112 for pumping fluid along a fluid flow path between a pump inlet 114 and pump outlet 116 of the compressor.

The fixed scroll 112 comprises a scroll wall 118 which extends perpendicularly to a generally circular base plate 120. The orbiting scroll 122 comprises a scroll wall 124 which extends perpendicularly to a generally circular base plate 126. The orbiting scroll wall 124 co-operates, or meshes, with the fixed scroll wall 118 during orbiting movement of the orbiting scroll. Relative orbital movement of the scrolls causes a volume of gas to be trapped between the scrolls and pumped from the inlet to the outlet.

A scroll pump is typically a dry pump and not lubricated. In order to prevent back leakage, the space between the axial ends of a scroll wall of one scroll and the base plate of the other scroll is sealed by a tip seal 128. An enlarged cross-section through a portion of the fixed scroll 112 showing the tip seal 128 in more detail is shown in FIG. 11.

As shown in FIG. 11, the tip seal 128, typically made from a plastics material or rubber, is located in a channel 132 at the axial end 134 of the fixed scroll wall 118. There is a small axial gap between an axial end of the tip seal 128 and the base of the channel 132 so that in use fluid occupying the gap forces the tip seal axially towards the base plate 126 of the orbiting scroll. Accordingly, the tip seal is supported on a cushion of fluid which serves to urge the seal against an opposing scroll.

When bedding in or during use, the tip seals 128 are worn by contact with the opposing scroll base plate 120, 126 generating tip seal dust. When the pump is used for pumping a clean environment such as a vacuum chamber of a silicon wafer processing apparatus, it is desirable that the tip seal dust does not migrate upstream into the vacuum chamber, particularly during pump down times.

SUMMARY

The present invention provides a scroll compressor comprising a scroll pumping mechanism comprising:

an orbiting scroll having an orbiting scroll wall extending axially from an orbiting scroll plate towards a fixed scroll; and a fixed scroll having an fixed scroll wall extending axially from a fixed scroll plate towards the orbiting scroll; the compressor comprising an axially extending drive shaft having an eccentric shaft portion so that rotation of the eccentric shaft portion imparts an orbiting motion to the orbiting scroll relative to the fixed scroll for pumping fluid from an inlet to an outlet of the pumping mechanism;

wherein an axial end portion of one of the scroll walls has a first sealing arrangement and a second sealing arrangement arranged in series along the scroll wall from the inlet to the outlet for sealing between the axial end portion of the scroll wall and the scroll plate of the opposing scroll, said first sealing arrangement having first sealing characteristics which are selected according to sealing requirements local to the first sealing arrangements and said second sealing arrangement having second sealing characteristics which are selected according to sealing requirements local to the second sealing arrangements, and said first sealing characteristics are different from said second sealing characteristics.

Other preferred and/or optional aspects of the invention are defined in the accompanying claims.

BRIEF DESCRIPTION OF THE DRAWINGS

In order that the present invention may be well understood, an embodiment thereof, which is given by way of example only, will now be described with reference to the accompanying drawings, in which:

FIG. 6 shows another example of a scroll wall for the pump shown in FIG. 1;

FIG. 7 shows one further example of a scroll wall for the pump shown in FIG. 1;

DETAILED DESCRIPTION

Figure 1:
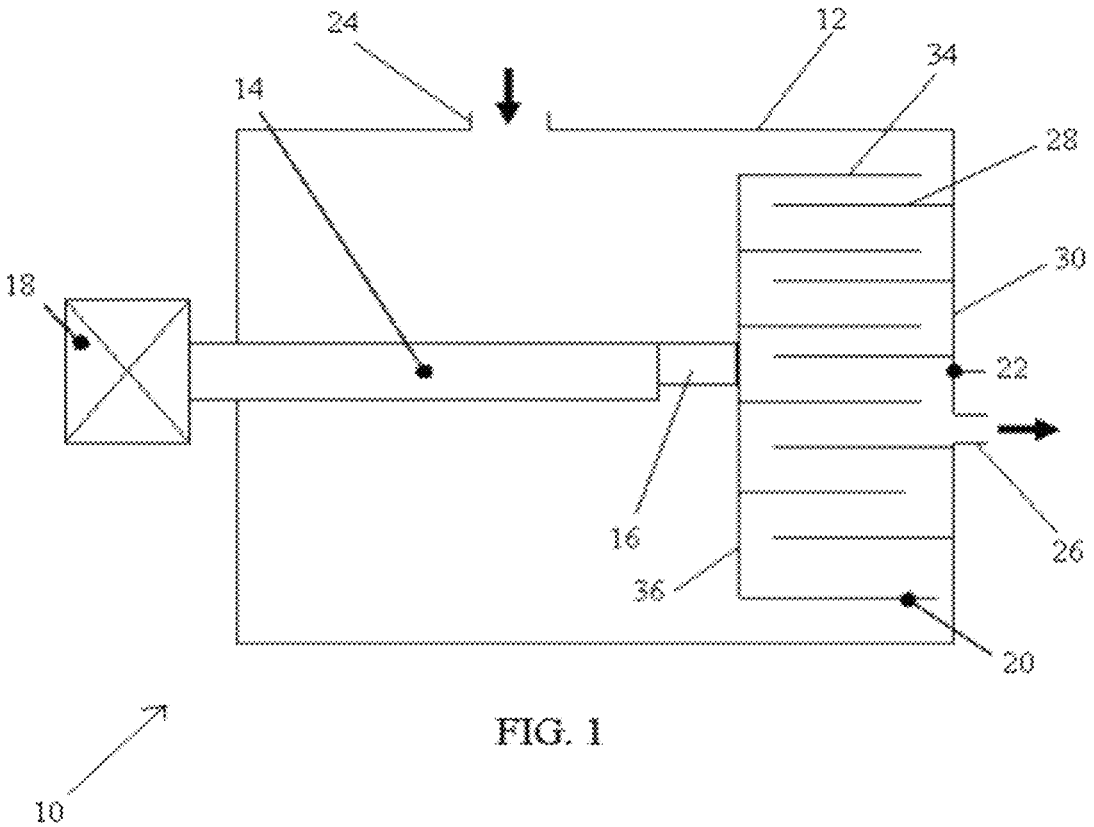
FIG. 1 shows schematically a scroll pump.

A scroll compressor, or pump, 10 is shown in FIG. 1. The pump 10 comprises a pump housing 12 and a drive shaft 14 having an eccentric shaft portion 16. The shaft 14 is driven by a motor 18 and the eccentric shaft portion is connected to an orbiting scroll 20 so that during use rotation of the shaft imparts an orbiting motion to the orbiting scroll relative to a fixed scroll 22 for pumping fluid along a fluid flow path between a pump inlet 24 and pump outlet 26 of the compressor.

The fixed scroll 22 comprises a scroll wall 28 which extends perpendicularly to a generally circular base plate 30. The orbiting scroll 20 comprises a scroll wall 34 which extends perpendicularly to a generally circular base plate 36. The orbiting scroll wall 34 co-operates, or meshes, with the fixed scroll wall 28 during orbiting movement of the orbiting scroll. Relative orbital movement of the scrolls causes a volume of gas to be trapped between the scrolls and pumped from the inlet to the outlet.

As indicated above with reference to the prior art, a scroll pump is typically a dry pump and not lubricated. Therefore, in order to prevent back leakage, the space between the axial ends of a scroll wall of one scroll and the base plate of the other scroll is sealed by sealing arrangement, which generally comprise tip seals. The tip seals close the gap between scrolls caused by manufacturing and operating tolerances, and reduce the leakage to an acceptable level. Tip seals suffer from the generation of tip seal dust. Further, in a normal scroll pump, tip seals require replacement at regular intervals after they become worn. Also, the channel 132 shown in FIG. 9 must be machined in order to locate the tip seals and machining adds to the cost of manufacture.

Figure 2:
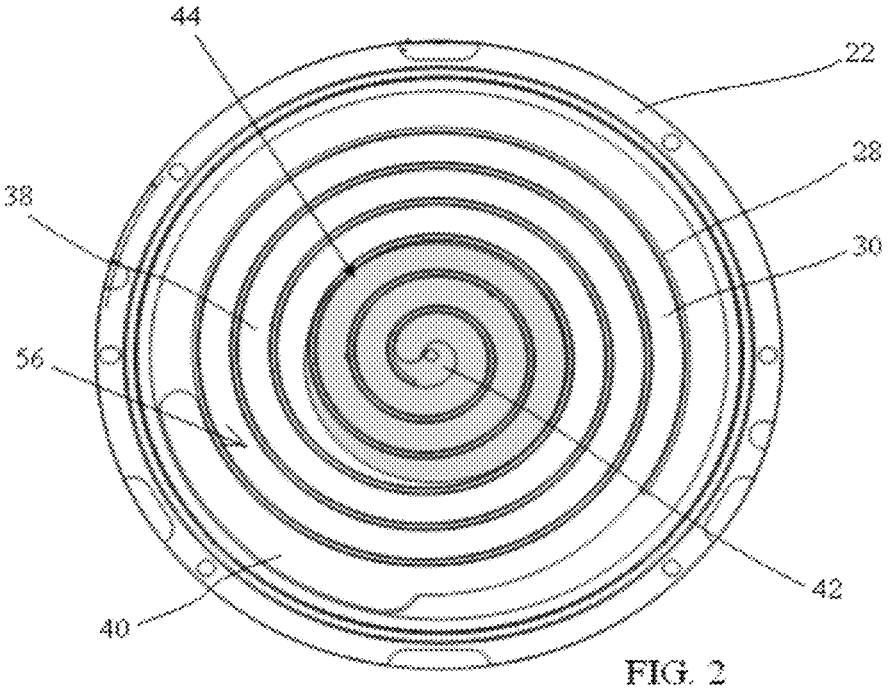
FIG. 2 shows a plan view of a fixed scroll of the scroll pump shown in FIG. 1.

FIG. 2 shows a fixed scroll 22. Scroll 22 comprises scroll base plate 30 from which scroll wall 28 extends generally axially towards the base plate 36 of the opposing, orbiting, scroll 20. Successive wraps of the scroll wall 28 extending through 360 degrees define therebetween a pumping channel 38 for pumping fluid from an inlet 40 to and an outlet 42 of the scroll pumping mechanism.

Tip-seals typically fail by no longer providing sufficient control of back leakage. Examination of "failed" seals show that many seals have excessive wear limited to a local region for example towards the centre wraps 44 of a scroll as shown in FIG. 2, whilst the remainder of the seals towards the outer wraps 56 are relatively unworn and retain good depth.

Therefore, in accordance with embodiments of the invention, an axial end portion of at least one of the scroll walls has a first sealing arrangement and a second sealing arrangement arranged in series along the scroll wall from the inlet to the outlet for sealing between the axial end portion of the scroll wall and the scroll plate of the opposing scroll, said first sealing arrangement having first sealing characteristics which are selected according to sealing requirements local to the first sealing arrangements and said second sealing arrangement having second sealing characteristics which are selected according to sealing requirements local to the second sealing arrangements, and said first sealing characteristics are different from said second sealing characteristics. The invention covers not only two sealing arrangements in series but a plurality of such sealing arrangement in series. Local conditions include without limitation pressure differential across a scroll wall, absolute pressure on each side of a scroll wall, tip seal wear rate, molecular/non-molecular flow, back-leakage requirements, required compression and pump speed, and power consumption. The sealing characteristics are selected to meet such local conditions and may include, variations in the size or aspect of a tip seal, the material of the tip seal, the absence of a tip seal, and the provision of formations, such as pockets in an axial end face of a scroll wall.

The replacement of a standard tip-seal having constant sealing characteristics between the inlet and the outlet offers a number of advantages. Embodiments of the invention provide two or more discrete sealing arrangements in series, within a given spiral form, in order to optimise each section according to its local operating conditions.

The first sealing arrangement is arranged along the scroll wall towards the inlet and the second sealing arrangement is arranged towards the outlet of the pumping mechanism. Typically, the pressure differential across a scroll wall towards the outlet is higher than the pressure differential across a scroll wall towards the inlet. Accordingly, there is a greater propensity for back-leakage to occur towards the outlet than towards the inlet. Therefore, the second sealing arrangement is required to provide better sealing capability than the first sealing arrangement. In other words, the second sealing arrangement is more resistant to back-leakage than the first sealing arrangement. Accordingly, the size of the tip seal of the first sealing arrangement is reduced to decrease the amount of tip seal dust which is generated when the pump is in use. Alternatively, the first sealing arrangement may consist of an axial end face of a scroll without a tip seal. In this way, not only can the generation of tip seal dust be decreased but also power consumption can be reduced since there is less resistance to movement with a smaller tip seal or in the absence of a tip seal. By way of further examples, when the sealing arrangements comprise respective tip seals received in respective channels at the axial ends of the scroll walls the sealing characteristics are one or more of an axial height, a radial width, or a material of the tip seals.

Figure 3:
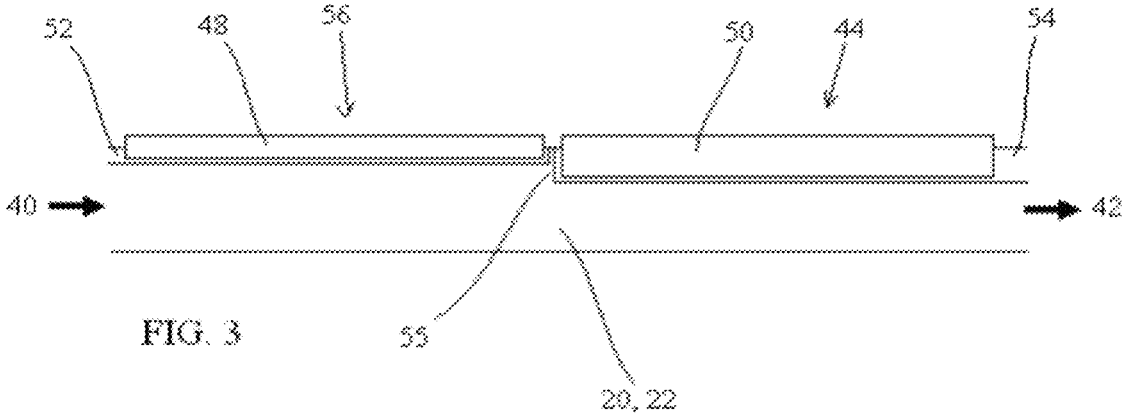
FIG. 3 shows one example of a scroll wall for the pump shown in FIG. 1.

FIG. 3 is a cross section of one of the scroll walls 20, 22 taken along a centre line of the scroll wall and following an involute, or otherwise spiral, path of the scroll wall from the inlet 40 to the outlet 42. The first sealing arrangement of the centre wraps 44 comprises a first tip seal 48 and the second sealing arrangement of the outer wraps 56 comprises a second tip seal 50. The first and second tip seals are received in respective channels 52, 54 machined, or otherwise formed in the axial end portion of the scroll wall or walls. A dividing wall 55 is provided to separate the first sealing arrangement from the second sealing arrangement forming discrete sealing arrangements in series along the scroll wall. The provision of discrete tip seals allows the tip seals to be readily formed from different materials for example. Alternatively, the tip seals 46, 48 may be formed integrally in which case there is no requirement for the dividing wall 55.

Typically, the wear rate of a tip seal is relatively low in the inlet region 56 and relatively high in the outlet region 44 (shown also in FIG. 2). The low wear rate of tip seals in the inlet region permits a shallow seal to be used since the consumption of the material of tip seal is less during use. A shallow tip seal requires a shallow tip seal groove, which can be machined more quickly and reduce machining and tip seal costs. Further, a thin seal can be used in the inlet region to speed up the bedding in process and reduce generated tip seal dust.

Figure 4:
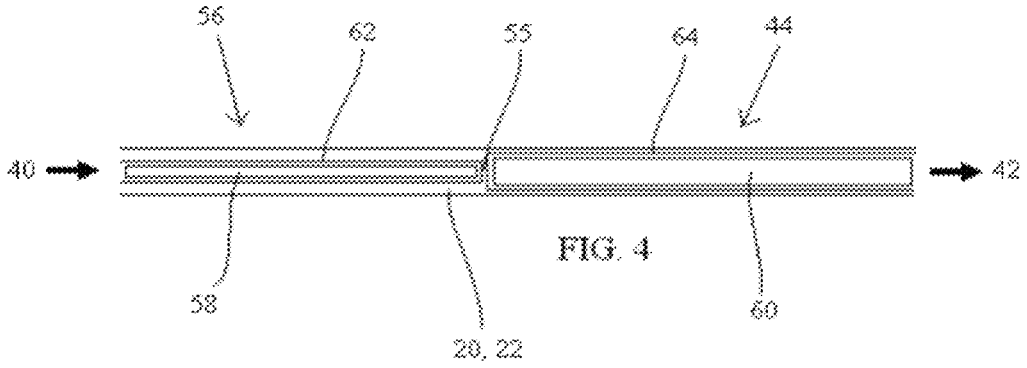
FIG. 4 shows another example of a scroll wall for the pump shown in FIG. 1.

FIG. 4 shows a plan view a scroll wall 20, 22 as it would appear if it were unwound from an involute to form a straight wall from the inlet 40 to the outlet 42. FIG. 4 shows another example in which the first sealing characteristics are different from the second sealing characteristics.

In FIG. 4, the scroll wall 20, 22 has a first sealing arrangement which comprises a first tip seal 58 and a second sealing arrangement which comprises a second tip seal 60. The first and second tip seals are received in respective channels 62, 64 machined, or otherwise formed in the axial end portion of the scroll wall or walls. A dividing wall 55 as described above may be provided to separate the first sealing arrangement from the second sealing arrangement forming discrete sealing arrangements in series along the scroll wall.

As will be seen from FIG. 4, the first tip seal 58 has a smaller radial width than the second tip seal 60. Accordingly, the tip seal 60 offers greater sealing capability at the outlet region 44, where back-leakage is more pronounced. Tip seal 58 is located at the inlet region 56 where back-leakage is less pronounced and therefore adequately seals the scroll pumping mechanism with a smaller radial width. A tip seal with a smaller radial width produces less tip seal dust in use.

Additionally, the provision of a wider tip seal can be used on the orbiting scroll as a buffer, or damper, to stabilise axial movement of the scrolls.

The arrangements shown in FIGS. 3 and 4 can be combined to provide a first tip seal which is axially shorter and radially smaller than the second tip seal which is axially longer and radially larger. The provision of a smaller first tip seal which is smaller than the second tip seal, whether that be axial height or radial width, or both, allows less material to be used in the manufacture of the tip seals reducing material and machining costs.

The tip seals shown in FIGS. 3 and/or 4 can also be made from different materials. For example, the second tip seal 50, 60 may be made from a relatively hard material so that it provides greater resistance to wear and therefore the maintenance period of the pump can be prolonged. The first tip seal 48, 58 may be made from a softer material because tip seal wear rate is not considered such a problem at the inlet region 56.

Accordingly, as described with reference to FIGS. 3 and 4, the second sealing characteristics are selected such that one or more of the axial height, the radial width or the hardness of the material is greater than the axial height, the radial width or the hardness of the material of the second sealing characteristics, respectively.

Figure 5:
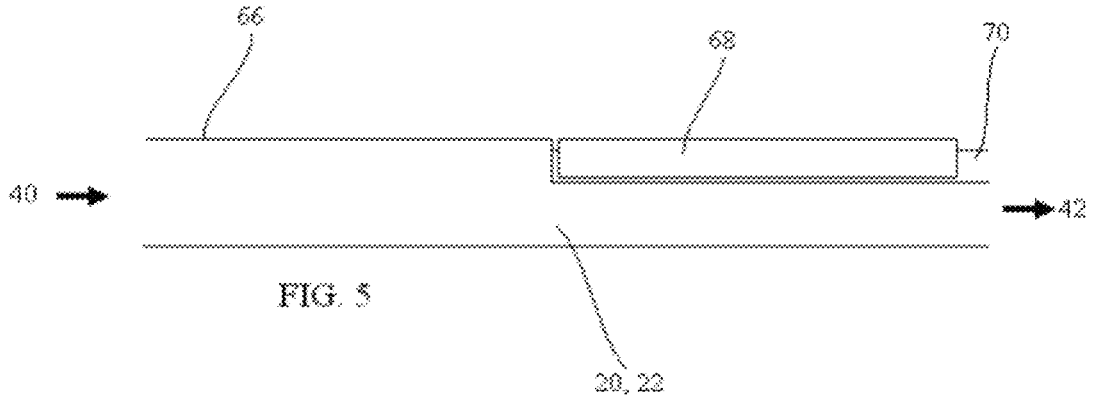
FIG. 5 shows a still further example of a scroll wall for the pump shown in FIG. 1.

FIG. 5 shows a plan view of a scroll wall 20, 22 as it would appear if it were unwound from an involute to form a straight wall from the inlet 40 to the outlet 42. FIG. 5 shows another example in which the first sealing characteristics are different from the second sealing characteristics.

In FIG. 5, the first sealing arrangement comprises a planar axial end face 66 of the scroll wall itself without a tip seal and the second sealing arrangement comprises a tip seal 68. Whilst the second tip seal is received in a channel 70 machined, or otherwise formed in the axial end portion of the scroll wall or walls, the first sealing arrangement does not require machining and therefore reduces manufacturing costs. The axial end face 66 has less sealing capability than that of the second tip seal 68, but depending on pumping requirement is an acceptable trade-off for the benefits of reduced manufacturing costs, decreased tip seal dust and reduced power consumption. Further, as the inlet region 56 is located closer to possibly sensitive vacuum processing apparatus than the exhaust region 44, the absence of a tip seal in region 56 further reduces the likelihood of contamination.

In a modification of the FIG. 5 arrangement shown in FIG. 6, the first sealing arrangement comprises an axial end face 72 of the scroll wall in which a plurality of pockets, or recesses or serrations, 74 are formed for resisting leakage of fluid between the axial end face 72 and the scroll plate 30, 36 of the opposing scroll. For explanatory purposes, FIG. 6B shows a plan view of the first sealing arrangement with pockets 74 formed in the axial end face 72 together with a radial section taken through the scroll wall in FIG. 6C. The pockets 74 act in molecular flow conditions less than 1 mbar to cause fluid molecules being pumped to move towards an outlet side of the scroll wall. When molecules hit the pockets in a first direction, the angled walls of the pockets transfer energy to molecules causing them to rebound in an opposing direction towards an outlet side of the scroll wall, as shown by the arrow in FIG. 6C showing net flow of molecules towards the outlet side of the scroll wall. As molecular condition may be found in the inlet region the first sealing arrangement having pockets 74 is located in the inlet region. The sealing arrangement at the inlet region 56 is not restricted to the particular shape of pockets shown in FIG. 6 and may consist of any shape of pockets which serve to produce the desired net flow of molecules across the axial end face 72.

FIG. 7 shows a modification of the scroll wall shown in FIG. 6. FIG. 7A shows a spiral section taken through the scroll wall and FIG. 7B shows a plan view of the scroll wall. In FIG. 7, the tip seal 68 is removed and the sealing arrangement at the exhaust region 44 comprises the axial end face 72 in which pockets 73 are formed. The pockets 73 consist of two rows of generally circular pockets which act to disrupt, or choke, the flow of gas across the axial end face 72. The pockets 73 are selected to reduce flow across the axial end face 72 in non-molecular flow conditions above about 1 mbar whereas the pockets 74 in the inlet region 56 are selected to reduce flow across the axial end face 72 in molecular flow conditions. The depth of the pockets 73, 74 (in the axial direction) may be same or as shown in FIG. 7, the pockets 73 may have a greater depth than the pockets 74, which may be advantageous to produce disruption to flow over the axial end face 72.

The sealing arrangement at the exhaust region 44 is not restricted to the particular shape of pockets shown in FIG. 7 and may consist of any shape of pockets which serve to produce the disruption to flow across the axial end face 72.

As shown in FIGS. 3 to 7, the first sealing arrangement and the second sealing arrangement are approximately equal in length. However, sealing requirements local to respective sealing arrangements need not necessitate equal length sealing arrangements. For example, it may be configured that the second sealing arrangement at the outlet region 44 is only one quarter the length of the first sealing arrangement.

The first and second sealing arrangements may comprise tip seals which in use contact a counter-face surface of the opposing scroll plate forming a seal. The characteristics of the seal formed are dependent not only on the size and material of the tip seals but also on the material, treatment or finish of the counter-face surface. Accordingly, the sealing characteristics of the first sealing arrangement and/or the second sealing arrangement can be selected by choosing an appropriate material, treatment or finish of the scroll plate of the opposing scroll wall. For example, the counter-face surface may be treated to increase or decrease friction between the contacting surfaces and therefore decrease wear rate for instance of the tip seal of the second seal arrangement located at the outlet region 44.

In the embodiments and modifications described hereto, one of the scroll walls is configured with first and second sealing arrangements having different sealing characteristics. Additionally, both the scroll walls can be configured with first and second sealing arrangements having different sealing characteristics. The orbiting scroll 20 may be provided first and second sealing arrangements and the fixed scroll wall may be provided with third and fourth sealing arrangements. The first and third (and second and fourth) sealing arrangements may be the same although as the fixed scroll and the orbiting scroll have slightly different local sealing requirements, the first and the third sealing (and second and fourth) arrangements may also have different sealing characteristics.

Figure 8:
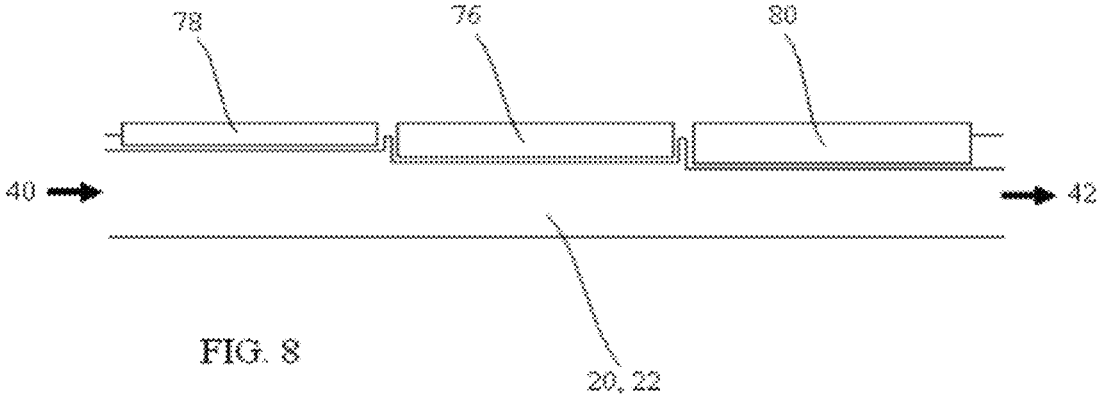
FIG. 8 shows another example of a scroll wall for the pump shown in FIG. 1.

In a further embodiment shown in FIG. 8, the axial end portions of one or both scroll walls 20, 22 comprise a third sealing arrangement 76 arranged in series along the respective scroll wall with a first 78 and a second 80 sealing arrangement from the inlet 40 to the outlet 42 for sealing. The third sealing arrangement 76 has third sealing characteristics which are selected according to sealing requirements local to the third sealing arrangement. The third sealing characteristics are different from one or both of the first and the second sealing characteristics. In the example shown the sealing characteristics are the axial height of the first, second and third sealing arrangements. More than three such discrete or integral sealing arrangements in series may be provided as required.

Figure 9:
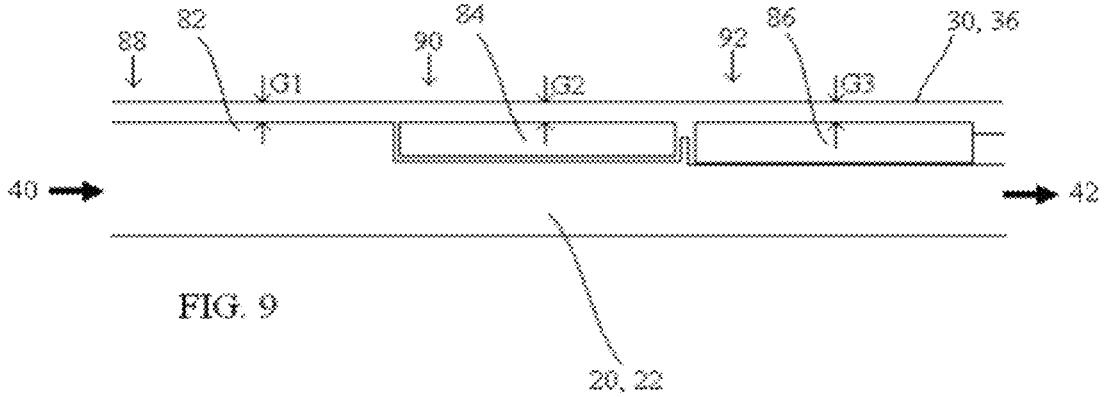
FIG. 9 shows another further example of a scroll wall for the pump shown in FIG. 1.

FIG. 9 shows another example in which the scroll wall is provided with three sealing arrangements in series. In FIG. 9, sealing arrangement 82 comprises an axial end face 83, without a tip seal, and which may if required be provided with pockets as shown for example in FIGS. 6 and 7. The sealing arrangement 82 is provided at an inlet region 88 of the scroll wall arrangement at which typically molecular flow conditions less than 1 mbar occur. Sealing arrangement 84 comprises a floating tip seal received in a channel formed in the axial end face of the scroll wall. Sealing arrangement 84 is provided at an intermediate region 90 of the scroll wall arrangement. Sealing arrangement 86 comprises a press fit, adhered or otherwise fixed, tip seal received in a channel formed in the axial end face of the scroll wall. Sealing arrangement 86 is provided at an exhaust region 92 of the scroll wall arrangement.

Figure 10:
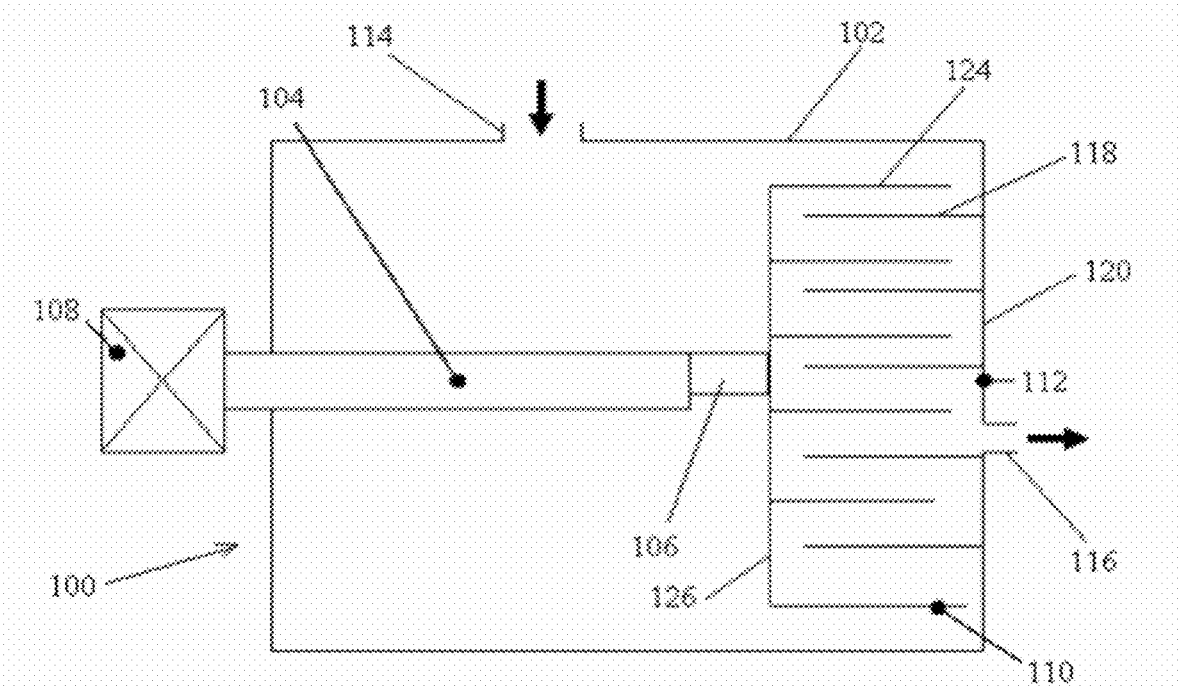
FIG. 10 shows a prior art scroll pump.
Figure 11:
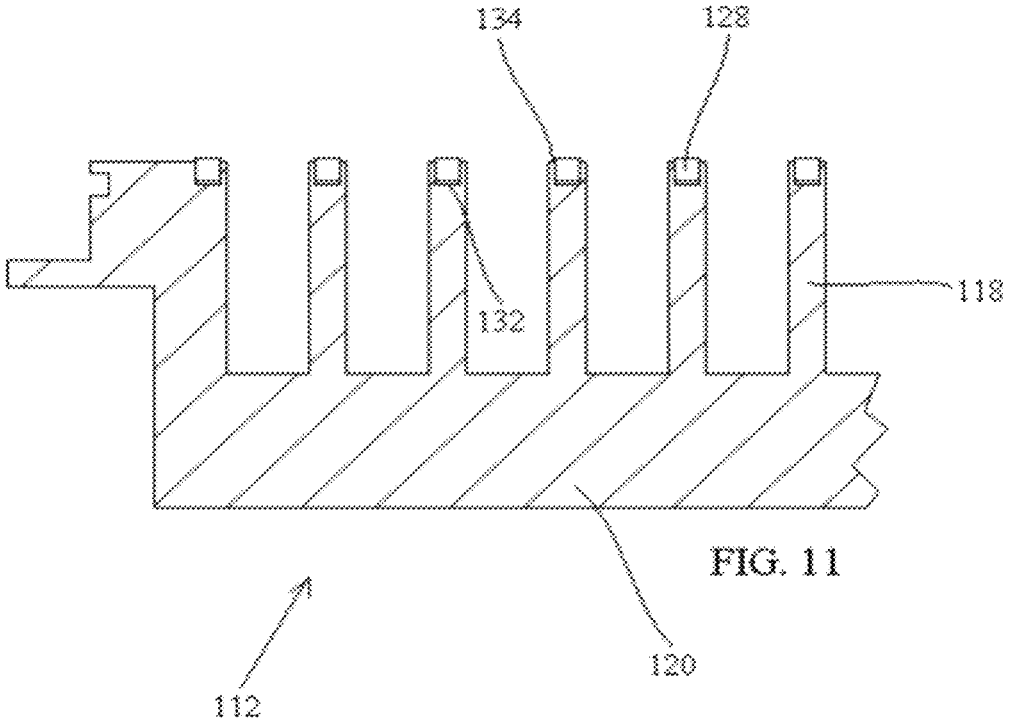
FIG. 11 shows a section through a scroll of the prior art scroll pump.

The three sealing arrangements 82, 84, 86 are selected to control the axial gaps G1, G2, G3 between the scroll wall or walls 20, 22 and the opposing scroll plate or plates 30, 36. The axial gaps control the amount of leakage across the scroll wall. If the axial gap is larger more leakage occurs and if the axial gap is smaller less leakage occurs. In the example shown in FIG. 9, the sealing arrangement 84 comprises a floating seal arrangement as described more particularly with reference to the prior art in FIGS. 10 and 11. A floating tip seal presses against the opposing scroll plate due to the pressure in the channel. Accordingly, a floating tip seal arrangement provides sealing properties tending towards a perfect seal in which no leakage across the scroll wall occurs. When no leakage occurs, all of the gas trapped in a pocket between the scrolls is compressed, which depending on requirements may or may not be desirable. For example, an increase in compression may result in a decrease in pumping speed or an increase in power consumption because a floating seal resists relative movement between the scrolls. If for example the scroll pump is used as a booster pump, it is desirable to have a high pumping speed but a lower compression. Further, a floating seal constantly presses against the opposing scroll plate causing wear of the tip seal and tip seal dust, leading to increased requirement for maintenance and replacement of tip seals and also to increased contamination. Accordingly, the example shown in FIG. 9 adopts a floating tip seal arrangement only over a portion of the scroll wall extent in the intermediate region of the scroll arrangement. The axial gap G2 over this region approaches zero and therefore high compression is achieved.

The sealing arrangement 86 comprises a fixed seal which has a fixed axial gap G3 from the scroll plate of the opposing scroll. In known arrangements in which a floating tip seal is provided at the exhaust region 92, high compression is achieved, potentially compressing gas to pressures above atmosphere. Typically, exhaust pressures above atmosphere are undesirable because the energy required to increase pressure above atmosphere is wasted in a vacuum pump. In the example shown, the fixed tip seal is selected to achieve an axial gap G3 which allows back-leakage to occur thereby decreasing resistance to relative movement of the scrolls. A fixed scroll may instead comprise an axial end face of the scroll wall in which pockets may be formed.

The sealing arrangement 82 does not comprise a tip seal but instead comprises an axial end face of the scroll in which pockets may be formed. The axial gap G1 is selected to allow a certain amount of back-leakage of molecules across the scroll wall thereby reducing compression but increasing pumping speed. Alternatively, the gap G1 is selected to be as small as possible within manufacturing and operating tolerances to minimise back-leakage.

Selection of the axial gap G1, G2, G3 between a scroll wall and an opposing scroll plate had been described with reference to FIG. 9. However, various alternatives to the FIG. 9 are possible. For example, any sealing arrangement which fixes the axial gap in the exhaust region allows a certain amount of leakage to occur. In FIG. 9 a fixed tip seal arrangement is shown, but alternatively, there may be no tip seal in the exhaust region and instead the axial gap is fixed between an axial end face of the scroll wall and the opposing scroll plate. The axial end face may be provided with pockets, for example pockets 73 as shown in FIG. 7. Additionally, the scroll wall arrangement may be provided with only two sealing arrangements in series. The first sealing arrangement being located at the inlet region and comprising a floating tip seal and the second sealing arrangement being provided at the exhaust region and comprising a fixed tip seal.

The invention claimed is:

1. A vacuum scroll compressor comprising:

a dry scroll pumping mechanism comprising:

an orbiting scroll having an orbiting scroll wall and an orbiting scroll plate;

a fixed scroll having a fixed scroll wall extending axially from a fixed scroll plate towards the orbiting scroll and defining a first axial end portion, wherein the orbiting scroll wall extends axially from the orbiting scroll plate towards the fixed scroll and defines a second axial end portion;

an inlet; and an outlet; and an axially extending drive shaft having an eccentric shaft portion so that rotation of the eccentric shaft portion imparts an orbiting motion to the orbiting scroll relative to the fixed scroll for pumping fluid from the inlet to the outlet of the scroll pumping mechanism for a single stage of the dry scroll pumping mechanism, wherein the first and second axial end portions each include a first sealing arrangement comprising fixed seals fixed in respective channels of the fixed scroll and the orbiting scroll and a second sealing arrangement comprising floating seals received in respective channels of the fixed scroll and the orbiting scroll, the first sealing arrangement and the second sealing arrangement being arranged in series along the respective first and second axial end portion from the inlet to the outlet for sealing between the first axial end portion and the orbiting scroll plate and between the second axial end portion and the fixed scroll plate.

2. The vacuum scroll compressor of claim 1, wherein the first sealing arrangement is arranged along the orbiting scroll wall and the fixed scroll wall in an inlet region and the second sealing arrangement is arranged along the orbiting scroll wall and the fixed scroll wall in an outlet region of the dry scroll pumping mechanism.

3. The vacuum scroll compressor of claim 2, wherein the fixed seals are configured to resist leakage of molecular flow and the floating seals are configured to disrupt leakage of non-molecular flow.

4. The vacuum scroll compressor of claim 1, wherein at least one of the first sealing arrangements or second the sealing arrangements further comprises one or more of a material, treatment or finish of the scroll plate of the opposing scroll, such that the material, treatment or finish of the scroll plate of the first sealing arrangement is different from the material, treatment or finish of the scroll plate of the second sealing arrangement.

5. The vacuum scroll compressor of claim 1, wherein the first sealing arrangements further comprise a first gap distance and the second sealing arrangements comprise a second, different axial gap distance.

6. The vacuum scroll compressor of claim 5, wherein the second sealing arrangements are located at an exhaust region and the second, different axial gap distance is larger than the first axial gap distance so that compression is reduced at the exhaust region.

7. The vacuum scroll compressor of claim 1, wherein the first and second axial end portions each comprise a third sealing arrangement arranged in series along the respective scroll wall with the first and the second sealing arrangements from the inlet to the outlet, wherein the third sealing arrangements each comprise a fixed seal or a floating seal, and wherein the third sealing arrangements are different from one or both of the first sealing arrangements and the second sealing arrangements.

8. The vacuum scroll compressor of claim 7, wherein the third sealing arrangements each comprise one of an axial end face of the respective scroll wall, an axial end face of the respective scroll wall having pockets formed therein, a floating tip seal received in a channel in the respective scroll wall, or a fixed tip seal.

9. The vacuum scroll compressor of claim 1, wherein each of the first sealing arrangements and the second sealing arrangements extend along at least one wrap of the respective scroll wall.

* * * * *